United States Patent [19]

Carter

[11] 4,225,775

[45] Sep. 30, 1980

[54] HAIR DRYER

[75] Inventor: Robert A. Carter, Asheboro, N.C.

[73] Assignee: General Electric Company, New York, N.Y.

[21] Appl. No.: 969,858

[22] Filed: Dec. 15, 1978

[51] Int. Cl.[3] ..... H05B 3/02; A45D 20/10

[52] U.S. Cl. ..... 219/375; 34/98; 219/370

[58] Field of Search ..... 219/368-371, 219/373-376, 380, 381; 34/96-100; 338/58, 218, 302-304, 318, 319, 321

[56] References Cited

U.S. PATENT DOCUMENTS

| | | | |
|---|---|---|---|
| 901,871 | 10/1908 | Blanchard | 219/370 |
| 1,468,593 | 9/1924 | Erb | 338/218 |
| 1,490,088 | 4/1924 | Bridges | 338/218 |
| 2,677,041 | 4/1954 | Oliver et al. | 219/370 |
| 2,730,609 | 1/1956 | Constantinesco | 219/370 |
| 3,095,496 | 6/1963 | Omohundro | 219/370 |
| 3,304,625 | 2/1967 | Gesmar | 219/368 |

FOREIGN PATENT DOCUMENTS

| | | | |
|---|---|---|---|
| 1084882 | 7/1960 | Fed. Rep. of Germany | 34/97 |
| 2659307 | 1/1978 | Fed. Rep. of Germany | 219/375 |
| 367944 | 4/1963 | Switzerland | 219/370 |

*Primary Examiner*—B. A. Reynolds
*Assistant Examiner*—Bernard Roskoski
*Attorney, Agent, or Firm*—John F. Cullen; George R. Powers; Leonard J. Platt

[57] ABSTRACT

A hair dryer is provided having a first cup-shaped plastic housing with an air inlet and generally tangentially directed outlet to be connected to a hose coupling and thence to a soft bonnet on the head of the user. A sheet metal plate provides a motor and other internal components on one side and a fan on the opposite side with the fan directing air through the outlet. A second plastic cup-shaped housing is provided facing the first and the housing are secured together with the plate between them, the hair dryer having a controlled air heater in the outlet. To this general overall arrangement an improvement comprises a heater formed in the shape of a cone in at least one plane of the outlet and secured to a mounting plate covering the outlet such that, with the housing, the mounting plate and housing form the outlet duct which is faired to form a substantial rectangular-to-round outlet path. The heater has the apex of the cone directed upstream with the arrangement allowing the heater and mounting plate assembly to direct the air flow from rectangular-to-round to minimize air flow restriction to the outlet and the heater provides a constantly increasing heater surface to improve heat transfer to the outlet air. Additionally, the outlet is formed on a radius from the center of the housings to reduce the maximum dimension of the dryer.

3 Claims, 6 Drawing Figures

HAIR DRYER

BACKGROUND OF THE INVENTION

1. Field of the Invention

The invention relates to a hair dryer of the soft bonnet type wherein the power pack of the fan and heater may be slung over the user's shoulder and a connected hose directs the drying air to a soft bonnet on the user's head. To this known combination, the invention provides an improvement in the general outline of the power pack to provide for better heat transfer and minimizing of hot air flow restriction to improve the heat transfer and operating efficiency of a given hair dryer.

2. Description of the Prior Art

Hair dryers of light compact construction—mostly plastic and easily portable—where the power pack may be worn slung from the shoulder permitting freedom of movement by the user with a connected hose directed to a soft bonnet on the user's head, are well known. Generally, they have been large and bulky and are not overly efficient. Originally, while primarily metal, such hair dryers have long since reverted to molded plastic to provide lightweight but this has created some problems inasmuch as the plastic per se does not easily withstand the heat encountered in dryers. While plastic that resists heat is available, it is expensive and may not offer the structural rigidity necessary to fix the internal components such as the fan, and motor with its switching structure and heating means in position during rough usage.

A typical lightweight hair dryer for carrying by the user and allowing greater flexibility and use of plastics without overheating when providing sufficiently hot air for drying, is shown in U.S. Pat. No. 3,095,496 of common assignment with a square-to-round air inlet to outlet duct and it is to this general arrangement that the instant invention is directed to providing improvements wherein the same general combination provides a large reduction in the drying time and a smaller overall configuration with only a small increase in heater wattage.

SUMMARY OF THE INVENTION

It is an object of the invention to provide a hair dryer of the compact portable soft bonnet type that is made of plastic and designed to be bounced about when slung on the hip of the user while also providing sufficient heated air in a novel heater arrangement that improves heat transfer resulting in an overall reduction in size for better output.

Another object is to provide such a heater where air flow restriction is minimized by both the heater structure and the outlet duct configuration which is redesigned to permit much more flexible use of the hair dryer with a reduction in drying time for a small increase in heat energy—all provided in a smaller overall package.

Briefly described, a hair dryer is supplied having a first cup-shaped plastic housing with a square air inlet opening and a generally tangential round outlet for a hose coupling directed to a soft bonnet. A sheet metal plate supporting a motor with its internal components and supporting a fan on opposite sides is provided with the fan directing air through the outlet. A second similar plastic cup-shaped housing is disposed facing the first and means secure the housings with the plate therebetween. A controlled air heating means is provided in the outlet all in a known manner. To this combination, an improvement is provided comprising a generally straight-sided heater formed as a cone in dual planes of the outlet, such as the horizontal and vertical plane, and a mounting plate covers the outlet to cooperate with the second housing and form the outlet duct. The outlet is preferably formed so that the mounting plate and housing are faired from a rectangular-to-round outlet duct minimizing air flow restriction. The heater is secured to the mounting plate with the cone apex downstream such that the heater and mounting plate assembly direct the air flow and also present a constantly increasing heater surface for better heat transfer to the passing air. The overall housing structure is disposed such that the exit of the outlet is formed on a radius from the center of the housings to reduce the overall maximum dimension of the dryer. Thus, the main object of the invention is to provide a hair dryer with a novel heater structure and outlet location such that the heat transfer is increased, the restriction to air flow is decreased, and the overall size of the dryer is reduced to result in a higher efficiency dryer with substantially the same heating capacity such that the drying time is substantially reduced.

DESCRIPTION OF THE PREFERRED EMBODIMENT

Figure 1:
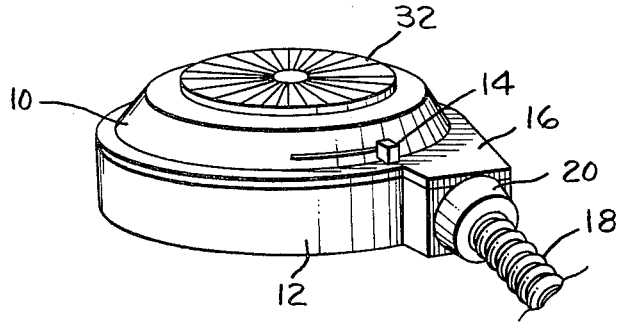
FIG. 1 is a partial perspective of the assembled power pack.
Figure 2:
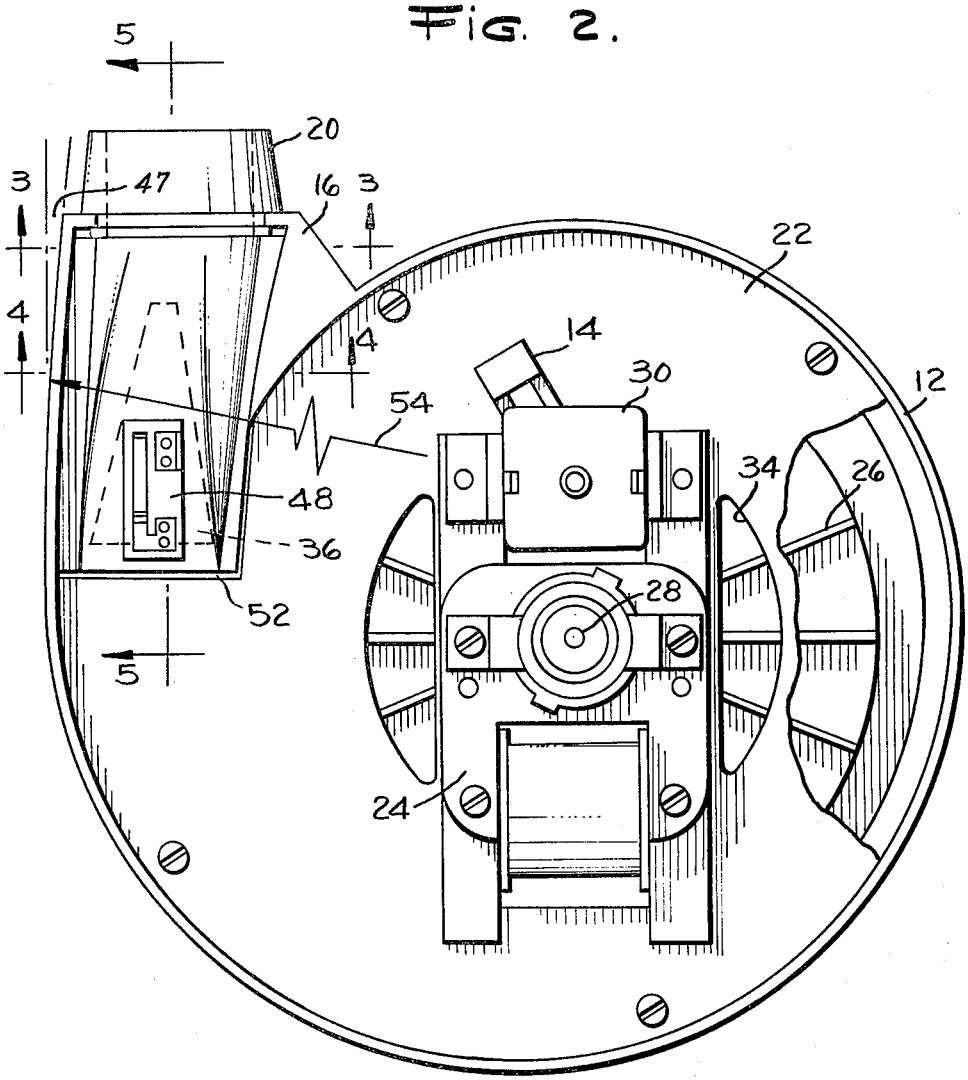
FIG. 2 is a plan view of the power pack with the first housing removed and partially broken to show the fan.

The instant invention is an improvement on U.S. Pat. No. 3,095,496 of common assignment and generally uses the same parts in the same manner except for improvements disclosed herein to decrease the drying time and reduce the overall size, with only a slight increase in the heating wattage resulting in a much more efficient hair dryer. Referring to FIGS. 1 and 2 there is shown a hair dryer assembly comprising a first cup-shaped lightweight plastic housing 10 and a second similar cup-shaped plastic housing 12 that are symmetrical and face one another and are secured together as shown in FIG. 1. Thus, when the housings are faced and secured together they form a hollow center suitable for containing the dryer components. The hair dryer in FIG. 1 is made to be worn by a strap (not shown) slung from the shoulder of the user and attached to a suitable ring so that the second housing 12 fits against the body or may be set on a table. A suitable control 14 to set the heat and fan speed extends out of first housing 10 for operation by the user. Also extending generally tangentially from the circular shaped housings 10 and 12 is an outlet 16 to which is attached a hose 18 by means of a universally rotatable coupling 20 with the hose 18 extending to the generally known soft bonnet not shown and worn by the user. The coupling 20, as later explained, permits complete rotation and, in conjunction with flexible hose 18, allows the use of the power pack of FIG. 1 in substantially any position when slung over the shoulder or placed on a flat surface.

Internally, as shown in FIG. 2, there is a sheet metal plate generally called an orifice plate 22 that carries the operating components with the plate 22 being sandwiched between the first and second housings 10 and 12 so that a unitary solid structure is provided wherein the components are rigidly affixed within the housing and the plate 22 serves to strengthen and add rigidity to the lightweight plastic housing structure. Thus, the plastic housing need not support the individual components permitting the use of plastic without the disadvantages of deformation of the plastic due to heating. As seen in FIG. 2, the overall power pack or assembled housings provide two compartments with the plate 22 supporting the motor 24 and other components such as control 14 on one side and a centrifugal fan 26 on the opposite side adjacent to and discharging through outlet 16. The fan is driven by a shaft 28 extending through the center of plate 22 and is suitably supported in bearings 28 in a well known manner and the fan 26 is also preferably formed of plastic. On the same side of plate 22 as the motor, are any additional components such as switch 30 that is activated by control 14. The arrangement is such that when fan 26 operates, air is drawn in through housing opening 32 and into the upper motor compartment thus cooling the motor, passing through openings 34 in the plate down into the lower fan compartment in second housing 12 and then, as directed by centrifugal force, through exit outlet 16 to a point of use.

Figure 6:
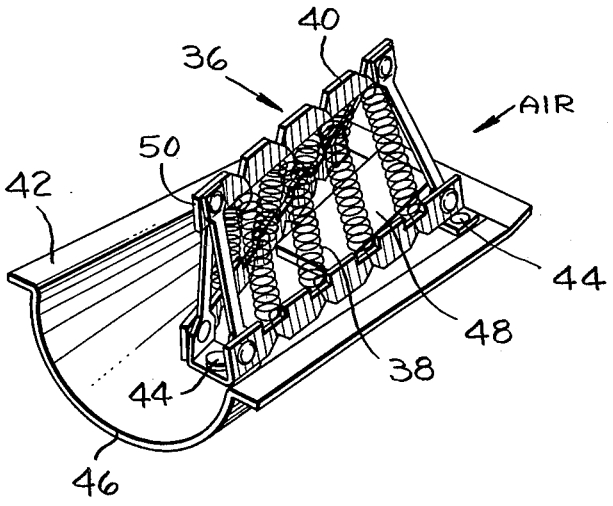
FIG. 6 is a perspective of the mounting plate and cone heater as used in FIG. 2.

In order to heat the air before it exits the power pack formed by first and second housings 10 and 12 and its enclosed components, a heater assembly 36 is disposed in the outlet 16. The structure thus far described, is generally well known and completely shown in said U.S. Pat. No. 3,095,496 patent upon which the instant invention improves. To this end, a modified and improved heater assembly 36, as better shown in FIG. 6, is formed as a cone in the fan outlet. As such, the cone may be in at least one plane of the outlet, for example the horizontal plane and is in the shape of a tent comprising resistance wires 38 wound about a suitable insulating frame 40 so that the entire formation is like a pup tent opening in the upstream direction as seen in FIG. 6. The actual form of the heater assembly 36 comprises a straight-sided cone in both the vertical and horizontal planes, the result being a constantly increasing heater surface as presented to the air as it moves to exit the power pack from right to left as shown by the arrow in FIG. 6. More particularly it is seen from FIG. 6, that the angle formed at the upstream end of the heater decreases as it is disposed toward the downstream end of the structure. At the same time the heater structure side elements taper slightly from the upstream to the downstream end of the heater structure. Any cone shape will provide the constantly increasing heater surface but the one shown in preferred because it presents such a surface in two planes—the horizontal and vertical—as will be apparent in FIG. 6 although a cone in a single plane will improve the heat exchange between the air and wires 38 but not quite as well as the dual plane cone form shown.

For supporting the heater assembly 36, there is provided a formed or shaped mounting plate 42 that secures the heater within its confines by rivets 44 and the mounting plate is shaped somewhat in the form of a scoop or shovel being flat at one end and curved at the other end 46 in a circular form. For protection, a suitable thermostat 48 may be secured to mounting plate 42 in a formed opening in the plate to operate in a conventional fashion of sensing temperature and shutting down in the event of an overtemperature condition. With the cone apex 50 of the heater assembly facing downstream it will be seen that the air moving in the direction of the arrow is heated as it passes over first resistance wire 38 and that heated air is again heated by the next resistance wire downstream and so on thus the air encounters a constantly increasing heater surface to improve the heat transfer to the air passing through the heater assembly.

Figure 3:
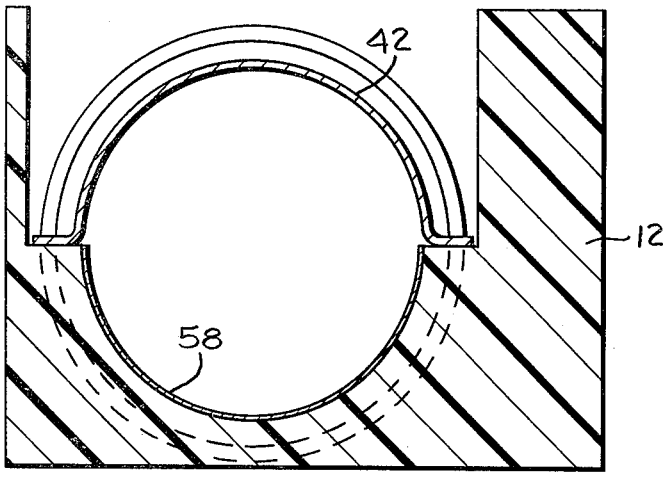
FIG. 3 is a sectional view on line 3—3 of FIG. 2.
Figure 4:
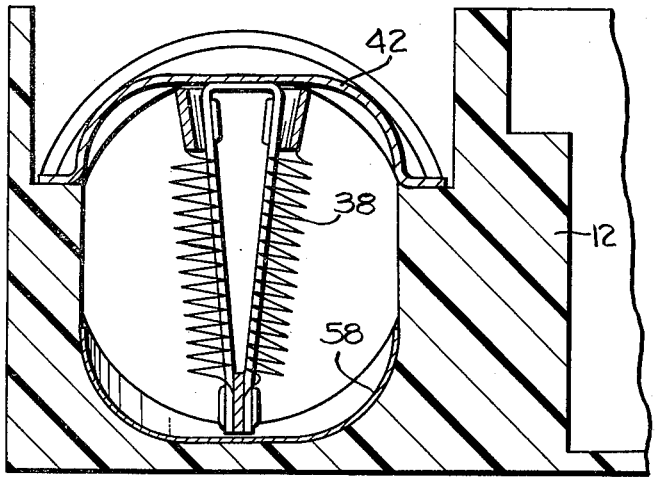
FIG. 4 is a sectional view on line 4—4 of FIG. 2.

In order to improve the air flow characteristics and, because of the shape of the housings 10 and 12, there is an inherently rectangular inlet 52 formed as part of the path into outlet 16 and any sharp changes, as in the above patent, introduce losses. To this end, the mounting plate 42 is formed to cooperate with the second housing 12 by fairing or molding the housing 12 such that it goes from a generally square shape of FIG. 4 into the round shape of FIG. 3 while the mounting plate 42 is similarly shaped as shown in FIG. 6. The result is that the mounting plate and second housing form a substantially rectangular-to-round air outlet duct minimizing any air flow restriction to the outlet through heater 36. For further flexibility of coupling 20, the exit of the outlet 16 is circular and has a groove 54 cooperating with a similar groove on circular coupling 20 so that the coupling is universally rotatable in the exit permitting it to attach hose 18 for movement to any position.

A further improvement is provided in the overall power pack by forming the outlet 16 on a radius 54 from the center of the housing thus reducing the overall maximum dimension of the dryer by a small amount as shown at 47 between the truly tangential exit dotted and the solid radius exit of outlet 16.

Figure 5:
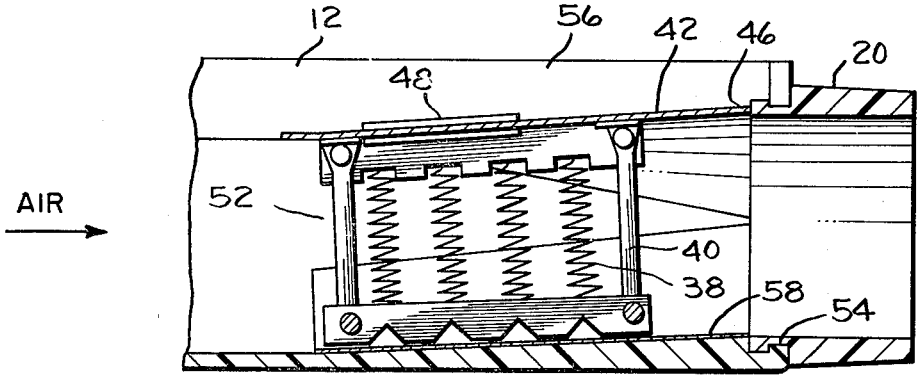
FIG. 5 is a sectional view on line 5—5 of FIG. 2.

Because the air exiting outlet 16 is heated to as high as 200° F., it is necessary to protect the plastic housings and to this end, the first cup-shaped housing 10 is protected by insulating chamber 56 that is formed above the mounting plate 42 between the plate and housing 10 as seen in FIG. 5. This is a relatively substantial distance and provides a blanket of air between the upper portion of mounting plate 42 and its adjacent housing 10. Thus, the mounting plate 42 acts as a heater support, a wall of the exit conduit or duct for the heated air, and a partition between the plastic housing 10 and the high temperature air. On the opposite side, the faired housing that changes from square to round is protected by the interposition of a deformable foil liner 58 that is formed by pressing into the housing opposite mounting plate 42 thus shielding the lower housing portion from the radiant heat. Thus, both plastic housings are protected from the radiant heat by using the mounting plate 42 to perform multiple functions at one side and a simple light and inexpensive foil liner on the opposite side.

The above improvements to the basic combination of said U.S. Pat. No. 3,095,496 patent comprising its different heater system, its overall slight reduction in size by forming the outlet on a radius, and the gradual fairing of the parts to provide for smooth transition and linear flow, have produced a hair dryer wherein the drying time is substantially reduced over the device of said '496 patent for a slight increase in wattage all while maintaining the lightweight, inexpensive, easily assembled, and overall smaller package for improved results.

While I have hereinbefore shown and described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a hair dryer having a first cup-shaped plastic housing with a duct of a substantially rectangular air inlet opening and generally tangential round outlet for a hose coupling to a soft bonnet, a sheet metal plate supporting a motor and components and a fan on opposite sides thereof with the fan adjacent the round outlet, a second plastic cup-shaped housing facing said first and means securing said housings and plate therebetween with controlled air heating means in said outlet, the improvement comprising:

said air heating means formed with straight side elements forming a point in a longitudinal plane of said outlet and said side elements angularly disposed about said longitudinal plane to form a decreasing angle from a direction upstream of an air flow through said outlet to downstream of said air flow, and wherein the side elements taper downward from a direction upstream of said air flow toward downstream of said air flow, a cup shaped mounting plate in said outlet and with said second housing, forming the outlet duct, a trucated cone shaped base supporting said straight side elements, means securing said base to the mounting plate, whereby the air heating means and mounting plate assembly direct the air flow and present a constantly increasing heater surface from square to round duct improving heat transfer to the outlet air.

2. A hair dryer as in claim 1 wherein said outlet is formed on a radius from the center of said housings reducing the maximum dimension of the dryer.

3. A hair dryer as in claim 2 having a deformable foil liner formed and disposed in said outlet in the housing rectangular-to-round portion opposite said mounting plate to shield the housing from said heater.

* * * * *